US005681251A

United States Patent [19]

Shew

[11] Patent Number: 5,681,251

[45] Date of Patent: Oct. 28, 1997

[54] DISTRIBUTOR ROLL

[76] Inventor: David W. Shew, 1414 Eleventh St. NE., Massillon, Ohio 44646

[21] Appl. No.: 461,634

[22] Filed: Jun. 5, 1995

[51] Int. Cl.[6] ..... B23P 15/00

[52] U.S. Cl. ..... 492/46; 162/342; 492/60

[58] Field of Search ..... 162/342, 341; 492/26, 60

[56] References Cited

U.S. PATENT DOCUMENTS

| | | | |
|---|---|---|---|
| 1,667,755 | 5/1928 | Valentine | 162/342 |
| 1,751,959 | 3/1930 | Trimbey et al. . | |
| 2,722,164 | 11/1955 | Duncan | 92/44 |
| 2,756,650 | 7/1956 | Lee | 92/44 |
| 2,860,552 | 11/1958 | Corbin | 162/342 |
| 3,255,074 | 6/1966 | Salomon et al. | 162/338 |
| 3,328,237 | 6/1967 | Notbohm | 162/343 |
| 3,694,312 | 9/1972 | Sköldkvist | 162/342 |
| 4,464,225 | 8/1984 | Bubik et al. | 162/181.6 |

*Primary Examiner*—Irene Cuda

*Attorney, Agent, or Firm*—Taylor & Associates, P.C.

[57] ABSTRACT

A distributor roll for use in a headbox of a paper-making machine, includes at least two support plates, with each said support plate having a circumferential edge. A plurality of square elongate members connect between the circumferential edges of the support plates. The support plates have at least one opening therein, whereby fluid pressure differentials on opposite sides of the support plates are equalized.

9 Claims, 1 Drawing Sheet

DISTRIBUTOR ROLL

BACKGROUND OF THE INVENTION

1. Field of the Invention

The present invention relates to headboxes in a paper-making machine, and, more particularly, to distributor rolls disposed in such headboxes.

2. Description of the Related Art

As known in the paper making art, a pressurized flow of fiber slurry is introduced into the headbox at an inlet. The headbox transforms the flow into a long narrow stream at an outlet to form a paper web. Distributor rolls, rotatably disposed within the headbox, are normally of a cylindrical tube type with a plurality of holes therein which induce turbulence within the fiber slurry when rotated within the headbox. Without such distributor rolls, the fibers in the fiber slurry clump together (i.e., flocculate) resulting in poor paper formation having clumps, splotches and streaks.

It is also known to provide distributor rolls, such as those shown in U.S. Pat. No. 2,722,164 to Duncan, with a plurality of elongate members which extend in a longitudinal direction of the roll, and are supported at spaced apart locations with solid spacer plates. These solid spacer or support plates inherently act to direct or change the pressure of the fiber slurry passing by and through the distributor roll. The creation of a directional or differential pressure on opposite sides of the spacer plates can cause streaking of the fiber web formed at the exit of the headbox.

What is needed in the art is a distributor roll which minimizes pressure differentials within the output of the headbox to maintain an even and streak-free paper web output.

SUMMARY OF THE INVENTION

The present invention is a cage-like distributor roll for a headbox of a paper-making machine. The distributor roll includes support plates spaced along a cylindrical structure that equalize pressure on each side of the support plates, thereby more fully deflocculating the fiber slurry and preventing streaks in the paper web.

Another aspect of the invention is that the distributor roll includes square or angled tubing with sharp edges. These edges increase the fluid shear within the headbox, thereby forming a more turbulent fiber mixture therein and leading to increased mixing of the fiber slurry.

The invention comprises, in one form thereof, a distributor roll for use in a headbox of a paper-making machine, including at least two support plates, with each said support plate having a circumferential edge. A plurality of elongate members connect between the circumferential edges of the support plates. The support plates have at least one opening therein, whereby fluid pressure differentials on opposite sides of the support plates are equalized.

An advantage of the present invention is that the support plates of the distributor roll include a plurality of openings therethrough to equalize fluid pressure on both sides of the support plates, thereby reducing the risk of streaks in the paper web at the headbox outlet.

Another advantage of the invention is that the invention utilizes square or angled hollow tubes moving through the headbox which increase fluid turbulence therein and reduce flocculation.

A further advantage of the present invention is that by the use of hollow tubes and cutout support plates, the entire distributor roll assembly is substantially lighter in weight than the prior art, thereby increasing bearing life and requiring a smaller motor and less power for rotation.

Yet another advantage of the present invention is that of an absence of a through driveshaft, by utilization of an axially mounted stub axis, thereby resulting in a decrease in the weight of the distributor roll.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
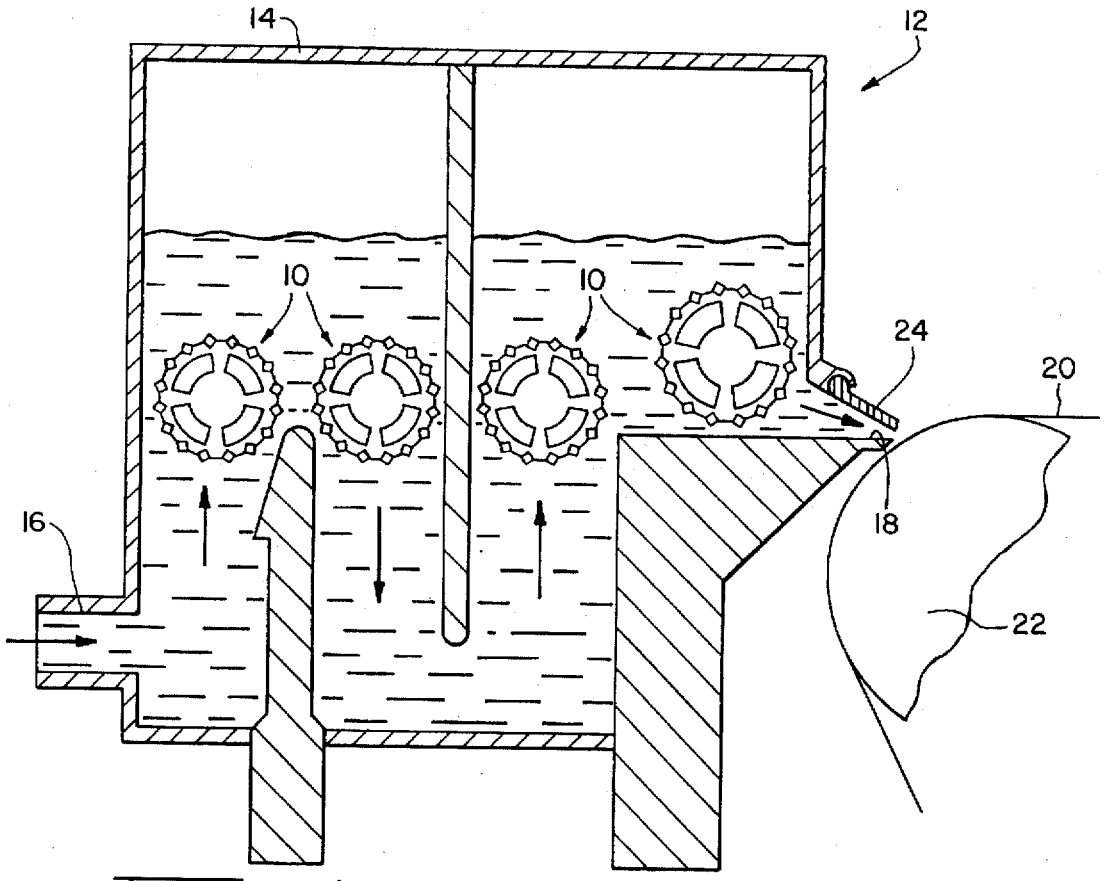
FIG. 1 is a cross sectional view of a headbox for a papermaking machine including one embodiment of a distributor roll of the present invention.
Figure 2:
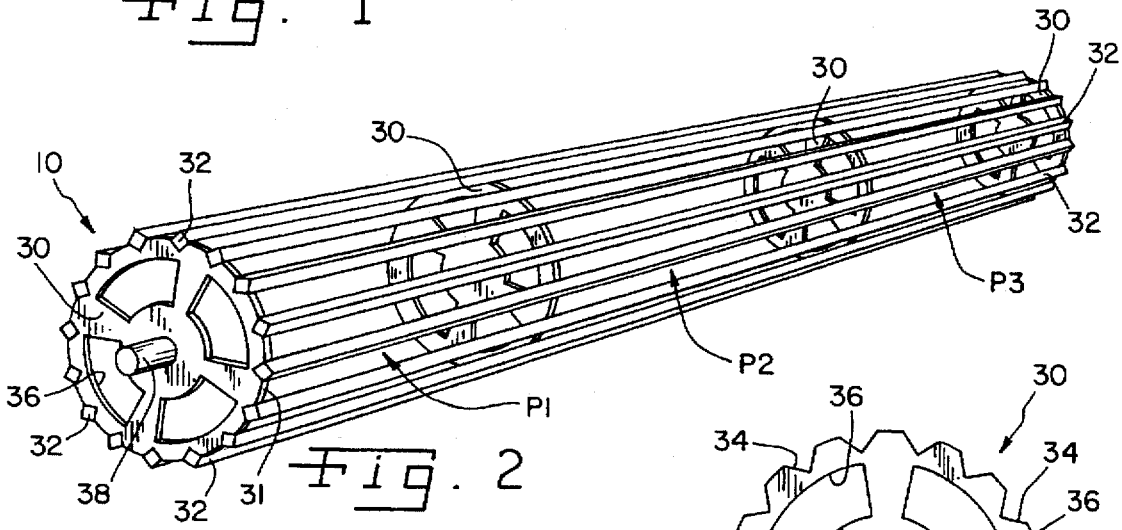
FIG. 2 is a perspective view of one of the distributor rolls shown in FIG. 1.

Referring now to the drawings and particularly to FIGS. 1 and 2, there is shown a distributor roll 10 of the present invention disposed within a headbox 12 of a typical paper-making machine. As shown in FIG. 1, headbox 12 includes a housing 14 including an inlet 16 and an outlet 18. As is known in the art, a fiber slurry/suspension is injected into headbox 12 through inlet 16, mixed and deflocculated by rotating distributor rolls 10, and then passed through outlet 18 into contact with a polyester wire 20 carried by breast roll 22. Breast roll 22 rotates, thereby causing wire 20 to move away from outlet 18. Fiber slurry exiting headbox 12 is carried by wire 20 to thereby form a paper web. A slice plate 24 is connected to housing 14 of headbox 12 and is further attached, e.g., to a spindle drive actuator assembly (not shown) that varies the position of slice plate 24 to thereby vary the thickness of the fiber slurry exiting headbox 12.

Distributor roll 10 of the present invention, as shown in FIG. 2, is formed of a plurality of disc-like support plates 30 which are provided on an outer circumferential edge 31 with a plurality of radially disposed elongate members such as blades 32. Both support plates 30 and blades 32 are formed of stainless steel or other metal suitable to withstand the conditions within headbox 12. Blades 32 are angled with relatively sharp edges, as shown in FIG. 2, and are preferably formed from hollow, square tubing, i.e., tubing square in cross section.

Figure 3:
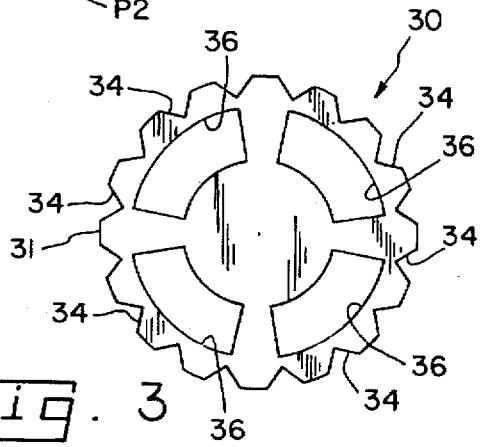
FIG. 3 is a front view of a support plate of the distributor roll of FIG. 2.

As shown in FIG. 3, each support plate 30 includes a plurality of radially disposed cutouts 34 along its circumference, into which blades 32 are attached as by welding. By attaching one corner of square tubing blade 32 toward the center of support plate 30, an opposite corner of square tubing blade 32 is pointed radially outward, thereby forming an outward sharp edge which, when rotated, increases fluid shear and turbulence within headbox 12.

Support plates 30 also include through openings 36 which are utilized to equalize pressure within distributor roll 10. These openings 36 in support plates 30 also equalize pressure within headbox 12 which is important adjacent to outlet 18. To wit, this equalization of pressure within headbox caused by openings 36 ensures that no streaks will be formed in the fiber slurry exiting outlet 18.

As shown in FIG. 2, distributor roll 10 is formed in a cylindrical fashion with two support plates 30 forming the axial end plates of the cylinder, while a plurality of other support plates 30 are placed therealong interior to axial end plates 30. As indicated in FIG. 2, chambers between support plates 30 within distributor roll 10 are labeled P1, P2 and P3.

Each of the support plates 30 at the axial ends of distributor roll 10 are provided with a stub shaft 38. One of the stub shafts 38 is connected to a gear or chain drive. A motor (not shown) is connected to the gearing or chain drive to thereby drive and rotate distributor rolls 10 within headbox 12, to thereby increase the turbulence within headbox 12 and form a uniform fiber slurry. By virtue of stub shafts 38 projecting away from the axial ends of distributor roll 10, an axle extending through the rotational axis of distributor roll 10 is not required, thereby reducing the weight of distributor roll 10.

In operation, distributor rolls 10 are disposed within headbox 12 while a fiber slurry is communicated through inlet 16. The fiber slurry flows, as indicated by the directional arrows, through and about distributor rolls 10 toward outlet 18. As this occurs, distributor rolls 10 are rotated by a motor and drive mechanism (not shown) which increases the turbulence within headbox 12, thereby fully mixing the fiber slurry and inhibiting flocculation. Openings 36 within support plates 30 cause the flow of the fiber slurry through the distributor roll 10 to be at a substantially equal pressure along the longitudinal length thereof, thereby preventing formations of streaks or other inconsistencies in the fiber slurry/paper web. More importantly, the distributor roll 10 located directly adjacent outlet 18 ensures proper mixing of the fiber slurry entering and exiting outlet 18. If any particular pressure variations are localized within chambers P1, P2 and P3, that pressure is relieved via the fiber slurry passing through openings 36 in support plates 30. Fluid shear created by the sharp edges of blades 36 provide the necessary mixing or turbulence action within headbox 12, thereby ensuring a substantial uniform fiber slurry exiting through outlet 18 towards breast roll 22.

In the absence of openings 36, the fluid pressure within chambers P1, P2 and P3 may vary from one to the other. As the fiber slurry exits distributor roll 10, the fiber slurry which is disposed at a higher pressure within one of chambers P1, P2 and P3 would cross over into the flow of fiber slurry exiting another of chambers P1, P2 and P3. Openings 36 prevent such cross flow and mixing which would result in streaks in the paper web being discharged onto wire 20 at outlet 18.

It is to be appreciated that the width of distributor roll 10 is substantially equal to the width of the associated headbox 12, which in turn is substantially equal to the width of breast roll 22 and polyester wire mesh 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A distributor roll for use in a headbox of a paper-making machine, said distributor roll comprising:

at least two support plates, each said support plate having a circumferential edge;

a plurality of hollow tubes connected to and extending between said circumferential edges of said support plates, each said hollow tube being square in cross section; and at least one of said support plates having at least one opening therethrough, whereby fluid pressure differentials on opposite sides of said at least one support plate are equalized.

2. The distributor roll of claim 1, wherein said circumferential edge includes a plurality of notches into which said hollow tubes interfit.

3. The distributor roll of claim 1, further comprising a stub shaft connected to and terminating at one of said support plates, said stub shaft rotatably supporting said distributor roll.

4. A distributor roll for use in a headbox of a paper-making machine, said distributor roll comprising:

at least two support plates, each said support plate having a circumferential edge;

a plurality of elongate members connecting between circumferential edges of said support plates, each said elongate member being square in cross section; and said support plates having at least one opening therein, whereby fluid pressure differentials on opposite sides of said at least one support plate are equalized.

5. The distributor roll of claim 4, wherein said circumferential edge includes a plurality of notches into which said elongate members interfit.

6. The distributor roll of claim 4, further comprising a stub shaft connected to and terminating at one of said support plates, said stub shaft rotatably supporting said distributor roll.

7. The distributor roll of claim 4, wherein said elongate members and said support plates consist essentially of stainless steel.

8. A distributor roll for inhibiting flocculation of a fiber slurry in a headbox of a paper-making machine, said distributor roll comprising:

at least two support plates, each said support plate having a circumferential edge;

a plurality of hollow tubes connected to and extending between said circumferential edges of said support plates, each said hollow tube having at least one longitudinal edge defining a means for inducing fluid shear within the fiber slurry; and at least one of said support plates having at least one opening therethrough, whereby fluid pressure differentials on opposite sides of said at least one support plate are equalized.

9. The distributor roll of claim 8, wherein said hollow tubes are multi-sided in cross section.

* * * * *